US006241927B1

(12) United States Patent
Mülleder et al.

(10) Patent No.: US 6,241,927 B1
(45) Date of Patent: Jun. 5, 2001

(54) METHOD OF PRODUCING CELLULOSE FIBERS

(75) Inventors: Eduard Mülleder, Linz; Christoph Schrempf, Bad Schallerbach; Hartmut Rüf, Vöcklabruck; Wilhelm Feilmair, Lenzing, all of (AT)

(73) Assignee: Lenzing Aktiengesellschaft, Lenzing (AT)

( * ) Notice: Subject to any disclaimer, the term of this patent is extended or adjusted under 35 U.S.C. 154(b) by 0 days.

(21) Appl. No.: 09/244,323

(22) Filed: Feb. 3, 1999

Related U.S. Application Data

(63) Continuation of application No. PCT/AT98/00151, filed on Jun. 17, 1998.

(30) Foreign Application Priority Data

Jun. 17, 1997 (AT) ..... 1053/97

(51) Int. Cl.[7] ..... D01D 4/02; D01F 2/02
(52) U.S. Cl. ..... 264/187; 264/211.14
(58) Field of Search ..... 264/187, 203, 264/211.11, 211.14, 211.16

(56) References Cited

U.S. PATENT DOCUMENTS

| | | | | |
|---|---|---|---|---|
| 2,179,181 | | 11/1939 | Graenacher et al. . | |
| 3,447,939 | | 6/1969 | Johnson . | |
| 3,447,956 | | 6/1969 | Johnson . | |
| 3,508,941 | | 4/1970 | Johnson . | |
| 4,144,080 | | 3/1979 | McCorsley, III . | |
| 4,246,221 | | 1/1981 | McCorsley, III . | |
| 5,047,197 | * | 9/1991 | Uneback et al. | 264/187 X |
| 5,094,690 | | 3/1992 | Zikeli et al. . | |
| 5,543,101 | | 8/1996 | Rüf et al. . | |
| 5,650,112 | | 7/1997 | Zikeli et al. . | |
| 5,798,125 | | 8/1998 | Zikeli et al. . | |
| 5,951,933 | * | 9/1999 | Stall et al. | 264/187 |

FOREIGN PATENT DOCUMENTS

| | | |
|---|---|---|
| 648808 | 9/1994 | (EP) . |
| 854215 | 3/1997 | (EP) . |
| WO94/28218 | 12/1994 | (WO) . |
| WO95/01470 | 1/1995 | (WO) . |
| WO96/13071 | 5/1996 | (WO) . |
| WO96/17118 | 6/1996 | (WO) . |
| WO96/18760 | 6/1996 | (WO) . |
| WO96/20300 | 7/1996 | (WO) . |
| WO96/21758 | 7/1996 | (WO) . |
| WO97/35054 | 9/1997 | (WO) . |
| WO98/06754 | 2/1998 | (WO) . |
| WO98/07911 | 2/1998 | (WO) . |
| WO98/18983 | 5/1998 | (WO) . |

* cited by examiner

*Primary Examiner*—Leo B. Tentoni
(74) *Attorney, Agent, or Firm*—Baker Botts L.L.P.

(57) ABSTRACT

The invention relates to a method of producing lyocell-type cellulose fibers by processing a spinnable solution of cellulose in an aqueous tertiary amine oxide according to the dry/wet-spinning process, which method is characterized in that a solution having a content of between 0.05% and 0.70% by mass, based on the mass of the solution, of cellulose with a molecular weight of at least $5\times10^5$ is used for spinning. The method of the invention allows the use of a spinnerette having more than 10,000 spinning holes for the spinning operation, which holes are arranged in such a manner that neighboring spinning holes are spaced maximally 3 mm apart and that the linear density of the spinning holes it at least 20.

5 Claims, 3 Drawing Sheets

METHOD OF PRODUCING CELLULOSE FIBERS

This is a continuation of copending application Ser. No. PCT/AT 98/00151, filed Jun. 17, 1998.

BACKGROUND OF THE INVENTION

The present invention relates to a method of producing lyocell-type cellulose fibers by processing a spinnable solution of cellulose in an aqueous tertiary amine oxide according to the dry/wet-spinning process.

In the past few years, a number of processes have been described as alternatives to the viscose process, processes in which cellulose is dissolved in an organic solvent, a combination of an organic solvent and an inorganic salt or in aqueous salt solutions, without the formation of a derivative. Cellulose fibers produced from such solutions were given the generic name of lyocell by BISFA (The International Bureau for the Standardisation of man-made Fibers). The term "lyocell" as defined by BISFA means a cellulose fiber obtained from an organic solvent by a spinning process. The term "organic solvent" as defined by BISFA means a mixture of an organic chemical and water.

Yet, to date, only a single method for the production of a lyocell type cellulose fiber has found acceptance to the extent of actual industrial realization, namely the amine oxide process. The preferred solvent used with this method is N-methylmorpholine-N-oxide (NMMO). For the purposes of the present specification, the abbreviation "NMMO" is substituted for the term "tertiary amine oxides", wherein the term NMMO additionally denotes N-methylmorpholine-N-oxide, which latter is preferably used today.

Tertiary amine oxides have been known to be alternative solvents for cellulose for a long time. From U.S. Pat. No. 2,179,181 it is f.i. known that tertiary amine oxides have the ability to dissolve high-grade chemical pulp without derivatization and that from such solutions cellulose molded bodies, such as fibers, can be obtained by precipitation. U.S. Pat. Nos. 3,447,939, 3,447,956 and 3,508,941 describe further methods of preparing cellulose solutions, with cyclic amine oxides being used as the preferred solvents. In all of these methods, cellulose is physically dissolved at elevated temperatures.

In the applicant's EP-A-0 356 419, a method is set forth which is preferably performed in a thin-film treatment apparatus in which a suspension of the shredded pulp in an aqueous tertiary amine oxide is spread in the form of a thin layer and transported over a heating surface, wherein the surface of that thin layer is exposed to a vacuum. As the suspension is transported over the heating surface, water is evaporated and the cellulose can be dissolved, a spinnable cellulose solution being hence discharged from the Filmtruder.

A method of spinning cellulose solutions is known fi. from U.S. Pat. No. 4,246,221. According to this method, the spinning solution is extruded into filaments through a spinnerette, which filaments are passed across an air gap into a precipitation bath in which the cellulose is precipitated. In the air gap, the filaments are stretched, thus enabling favorable physical properties, such as improved strength, to be imparted to the fiber. By precipitating the cellulose in the precipitation bath these favorable physical properties are fixed, and thus no further stretching will be required. This process is generally known as the dry/wet-spinning process.

In accordance with U.S. Pat. No. 4,144,080, the freshly spun filaments can be cooled with air in the air gap. Further, it is suggested to wet the surface of the filaments with a precipitating agent so as to reduce the danger of adhesion between the filaments. Yet, a disadvantage of such wetting is that the cellulose on the filament surface is precipitated, which renders it more difficult to adjust the properties of the fibers by stretching.

EP-A-0 648 808 describes a method of forming a cellulose solution, the cellulose ingredients of the solution comprising a first component made up of a cellulose having an average degree of polymerization (DP) of 500 to 2000 and a second component made up of a cellulose having a DP of less than 90% of the DP of the first component in the range from 350 to 900. The weight ratio of the first to the second component should be 95:5 to 50:50.

Applicant's WO 93/19230 improves the dry/wet-spinning process and enhances its productivity. This is effected by a particular blowing technique using an inert cooling gas, wherein the cooling is provided immediately below the spinnerette. In this way it is possible to markedly reduce the adhesiveness of the freshly extruded filaments and thus spin a denser filament curtain, i.e. to use a spinnerette having a high hole density, namely up to 1.4 holes/mm$^2$, whereby the productivity of the dry/wet-spinning process can of course be considerably enhanced. Air having a temperature between −6° C. and +24° C. is used for cooling the freshly extruded filaments.

Applicant's WO 95/02082 likewise describes a dry/wet-spinning process. With this process there is used a cooling air having a temperature between 10° C. and 60° C. The humidity of the supplied cooling air is between 20 g $H_2O$ and 40 g $H_2O$ per kilogram.

WO 95/01470 and WO 95/04173 by the applicant describe spinning methods employing a spinnerette having a hole density of 1.59 holes/mm$^2$ and a spinnerette having a total of 15048 holes, respectively. In each case, the cooling air has a temperature of 21° C.

WO 94/28218 quite generally suggests using spinnerets having 500 to 100,000 holes. The temperature of the cooling air is between 0° C. and 50° C. The person skilled in the art can gather from that document that the moisture lies between 5.5 g $H_2O$ and 7.5 g $H_2O$ per kilogram air. Hence this creates a relatively dry climate in the air gap.

WO 96/17118 also deals with the climate that prevails in the air gap, stating that the climate ought to be as dry as possible, namely 0.1 g $H_2O$ to 7 g $H_2O$ per kilogram air, at a relative humidity of less than 85%. The temperature proposed for the cooling air is 6° C. to 40° C. The person skilled in the art hence gathers from this literature that the climate during spinning is to be kept as dry as possible.

This can also be gathered from WO 96/18760, which suggests a temperature within the air gap of between 10° C. and 37° C. and a relative humidity of 8.2% to 19.3%, which results in 1 g $H_2O$ to 7.5 g $H_2O$ per kilogram air.

Applicant's WO 96/20300 i.a describes the use of a spinnerette having 28392 spinning holes. The air within the air gap has a temperature of 12° C. and a humidity of 5 g $H_2O$ per kilogram air. Hence, the tendency of keeping the climate within the air gap rather dry and cool, particularly when using a die with a substantially increased number of spinning holes, i.e. when spinning a relatively dense filament curtain, can be gathered from this literature, too.

WO 96/21758 is likewise concerned with the climate to be adjusted in the air gap, suggesting a two-step blowing technique using different cooling airs, and using a less humid and cooler air for blowing in the upper region of the air gap.

One drawback of using low-humidity air is that such air can only be conditioned at a certain expense. Considerable technical means are necessary in order to provide major quantities of low-humidity cooling air for the amine oxide process.

Also, it has been found that the cooling air becomes increasingly warmer and more and more humid as it passes through the filament curtain, since the freshly extruded fibers emerging from the spinnerette exhibit a temperature of more than 100° C. and a water content of about 10% and give off heat and moisture to the cooling air. The applicant has in fact found out that with very dense filament curtains such increasing uptake of water can lead to the situation that the necessary climate can only by adjusted through technically complex blowing devices and that without such devices the filament density cannot be further increased.

SUMMARY OF THE INVENTION

The invention therefore has as its object to obviate these disadvantages and provide a method of producing lyocell-type cellulose fibers by processing a spinnable solution of cellulose in an aqueous tertiary amine oxide according to the dry/wet-spinning process, allowing a dense filament curtain to be spun without the need for the blowing air to be dry. In spite of these conditions, the method is to be performed realizing a good spinnability, wherein spinnability is deemed the better, the smaller the minimum titer that can be achieved (see below).

In a method of the kind initially defined this is achieved in that a solution having a content of between 0.05% by mass and 0.70% by mass, in particular between 0.10 and 0.55% by mass, and preferably between 0.15 and 0.45% by mass, based on the mass of the solution, of cellulose and/or another polymer with a molecular weight of at least $5\times10^5$ (=500,000) is used for spinning.

The molecular weight is determined according to the chromatographic method described hereinbelow. For the purposes of the present specification, cellulose molecules or other polymer molecules that in accordance with the below-described chromatographic method produce signals corresponding to a molecular weight of at least $5\times10^5$ are referred to as long-chain molecules.

The invention is based on the recognition that the presence of long-chain cellulose molecules and/or other polymers in the spinning solution in the concentration range indicated improves the spinning behavior in such a way as to allow using a blowing air that need not be dry. Hence, even when blowing against very dense filament curtains a good spinnability is ensured even in those areas of the filament curtain that are located further outwards if viewed in the direction of blowing and that therefore can be reached only by "spent", i.e. considerably warmed and humid, blowing air.

It is essential for the invention that the indicated content of long-chain cellulose molecules be present in the spinning solution immediately before spinning. Since, as is generally known, the cellulose chains in a spinning solution are gradually degraded, one must try to already provide so large a portion of long-chain molecules when preparing the spinning solution that the degradation of the cellulose from the time of producing the spinning solution up to the time of actual spinning will not be so large that the minimum concentration according to the invention, i.e. 0.05% by mass, is fallen short of. It has been found that when using humid blowing air or at a humid climate within the air gap, the spinnability will markedly deteriorate if the content of long-chain molecules in the dope is below 0.05% by mass.

On the other hand, spinnability also deteriorates considerably if the concentration of long-chain molecules is above 0.70% by mass. This is true for spinning with both humid and dry blowing air.

With the method of the invention there are preferably used pulp mixtures that exhibit the indicated content of long-chain molecules in the spinning solution.

In this respect it can also be surprisingly shown that by spinning of a dope which contains such a pulp mixture, fibers with a lower tendency to fibrillation result. This effect even increases if air with a higher humidity is employed in the air gap.

N-methyl-morpholine-N-oxide has proved the most efficient tertiary amine oxide.

The invention further relates to the use of a spinnable solution of cellulose in an aqueous tertiary amine oxide, which solution has a content of between 0.05 and 0.70% by mass, particularly between 0.10 and 0.55% by mass, and preferably between 0.15 and 0.45% by mass, based on the mass of the solution, of cellulose with a molecular weight of at least $5\times10^5$, for producing cellulose fibers having a titer of maximally 1 dtex. Such lyocell fibers are novel.

The invention also relates to a lyocell-type cellulose fiber that is characterized in that it can be obtained by the process of the invention.

The invention also relates to a lyocell-type cellulose fiber that is characterized in that it exhibits a titer of maximally 1 dtex.

A preferred embodiment of the fiber of the invention has a content of between 0.25 and 7.0% by mass, particularly between 1.0 and 3.0% by mass, based on the mass of the cellulose fiber, of cellulose with a molecular weight of at least $5\times10^5$.

Another preferred embodiment of the fiber of the invention is the staple fiber.

The invention further relates to a method of producing cellulose fibers of the lyocell type by processing a spinnable solution of cellulose in an aqueous tertiary amine oxide by the dry/wet-spinning process, which method is characterized in that (1) a solution having a content of between 0.05 and 0.70% by mass, particularly between 0.10 and 0.55% by mass, and preferably between 0.15 and 0.45% by mass, based on the mass of the solution, of cellulose with a molecular weight of at least $5\times10^5$ is used for spinning and (2) a spinnerette having more than 10,000 spinning holes is employed for spinning, which holes are arranged in such a manner that neighboring spinning holes are spaced maximally 3 mm apart and that the linear density of the spinning holes it at least 20.

DETAILED DESCRIPTION OF THE PREFERRED EMBODIMENTS

The term "linear density" is a critical value defined by the applicant and indicates the number of fibers per millimeter of filament curtain that are flown through by the blowing air. The linear density can be calculated by dividing the total number of spinning holes of the die by the so-called area of incidence (in $mm^2$) and multiplying it by the length (in $mm^2$) of the air gap. The "area of incidence" is the area located at right angles to the spinning bath surface, which area is formed by the air gap (in mm) and by the row of filaments reached first by the blowing gas and the matching "row of holes" of the spinnerette and the line (total length in mm) formed thereby. For better clarity, reference is made to the appended FIG. 3.

Figure 3:
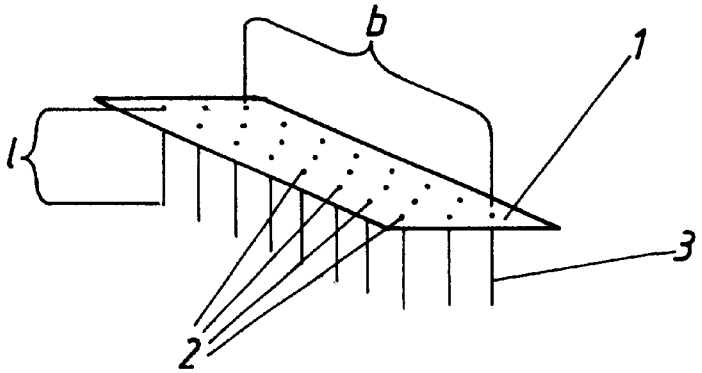
FIG. 3 is a perspective view of a rectangular spinning die.

FIG. 3 diagrammatically illustrates a rectangular die 1 having spinning holes 2 from which the filaments 3 are extruded. The length of the air gap is denoted "l". After passing the air gap, the filaments 3 enter the precipitation bath (not illustrated). In FIG. 3, the filaments have been illustrated only in the air gap.

The area of incidence is the mathematical product of the length "1" of the air gap and the width "b" of the first row of filaments. The linear density is therefore given by the following mathematical relation:

$$\text{linear density} = \frac{\text{spinning holes of the die}}{\text{area of incidence mm}^2} \times \text{air gap (mm)}$$

In the following, the invention will be described in greater detail.

1. General method for determining the molecular-weight profile of pulps

The molecular-weight profile of a pulp can be obtained through gel permeation chromatography (GPC), wherein the "differential weight fraction" in [%] is plotted as the ordinate against the molecular weight [g/mol; logarithmic plotting] in a diagram. There, the value "differential weight fraction" describes the percentage frequency of the mol mass fraction.

For examination by means of GPC, the pulp is dissolved in dimethyl acetamide/LiCl and is chromatographed. Detection is carried out by measuring the index of refraction and by so-called "MALLS" (=Multi Angle Laser Light Scattering) measurement (HPLC pump: by Kontron; sample collector: HP 1050, by Hewlett Packard; eluant: 9 g LiCl/L DMAC; RI detector: type F511, by ERC; laser wavelength: 488 nm; increment dn/dc: 1.36 ml/g; evaluation software; Astra 3d, Version 4.2, by Wyatt; column equipment: 4 columns, 300 mm×7.5 mm, packing material: PL Gel 20$\mu$-Mixed - A, by Polymer-Laboratories; sample concentration: 1 g/l eluant; injection volume: 40 $\mu$l, flow rate: 1 ml/min.

The measuring apparatus is calibrated by measures well-known to those skilled in the art.

Signal evaluation is carried out according to Zimm, wherein Zimm's formula has to be adjusted in the evaluation software, if necessary.

1.1. Molecular-weight profile of pulps

Figure 1A:
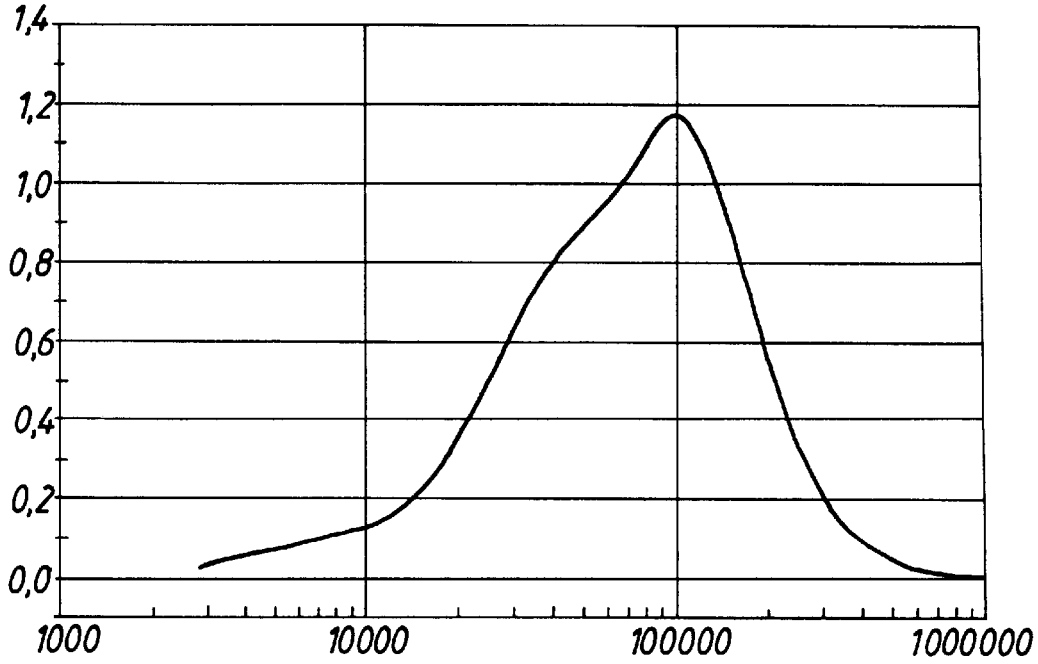
FIGS. 1*a*–1*d* are graphs of the molecular weight profile for Viscokraft LV pulp, Alistaple LD 9.2 Pulp, mixture of Viscokraft LV and Alistaple LD 9.2 pulp, and pulp precipitated from dope made from such mixture, respectively.

FIG. 1*a* provides an exemplary illustration of the molecular-weight profile for the Viscokraft LV pulp (manufactured by: International Paper). The diagram of FIG. 1*a* shows that this pulp for a great part is made up of molecules with a molecular weight of about 100,000 and that this pulp contains practically no portions (about 0.2%) with a molecular weight in excess of 500,000. A 15% cellulose solution solely of this pulp (for preparation, see below) in an aqueous amine oxide (=dope) thus does not correspond to the one used in accordance with the invention.

Figure 1B:
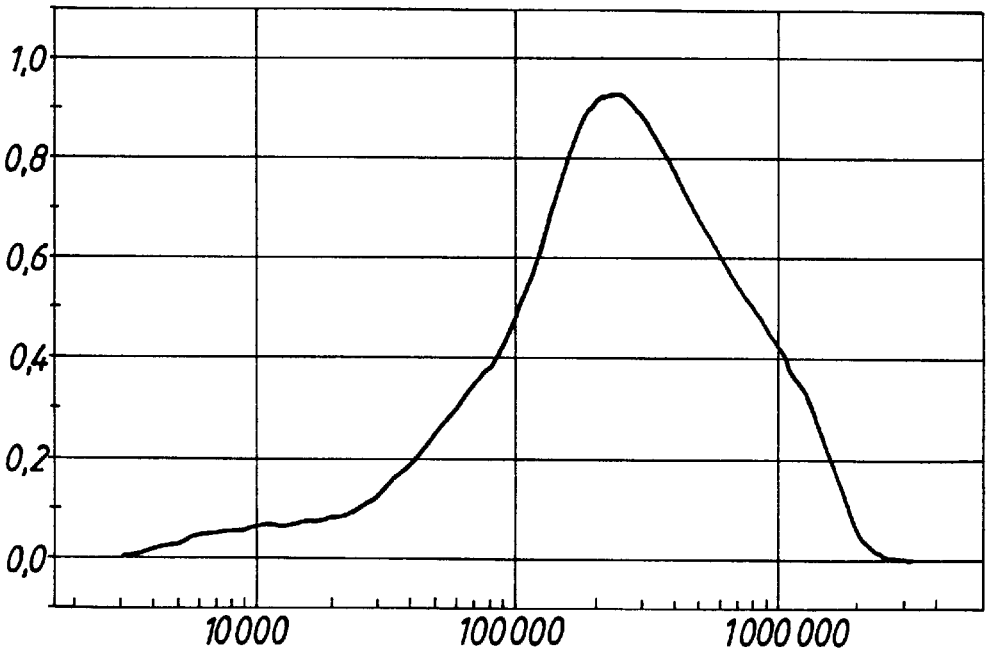

In comparison thereto, FIG. 1*b* shows the molecular-weight profile of the Alistaple LD 9.2 pulp (manufactured by: Western Pulp). With this pulp, a maximum of the frequency of mol mass is at roughly 200,000, and the diagram also shows that this particular pulp has a high percentage (about 25%) of molecules with a molecular weight greater than 500,000. A dope which exclusively contains this type of pulp in the amount of 15% by mass has roughly 4% (based on the mass of the solution; not allowing for degradation during the preparation of the solution) cellulose molecules with a molecular weight greater than 500,000 and thus does not correspond to the dope utilized in accordance with the invention either.

Figure 1C:
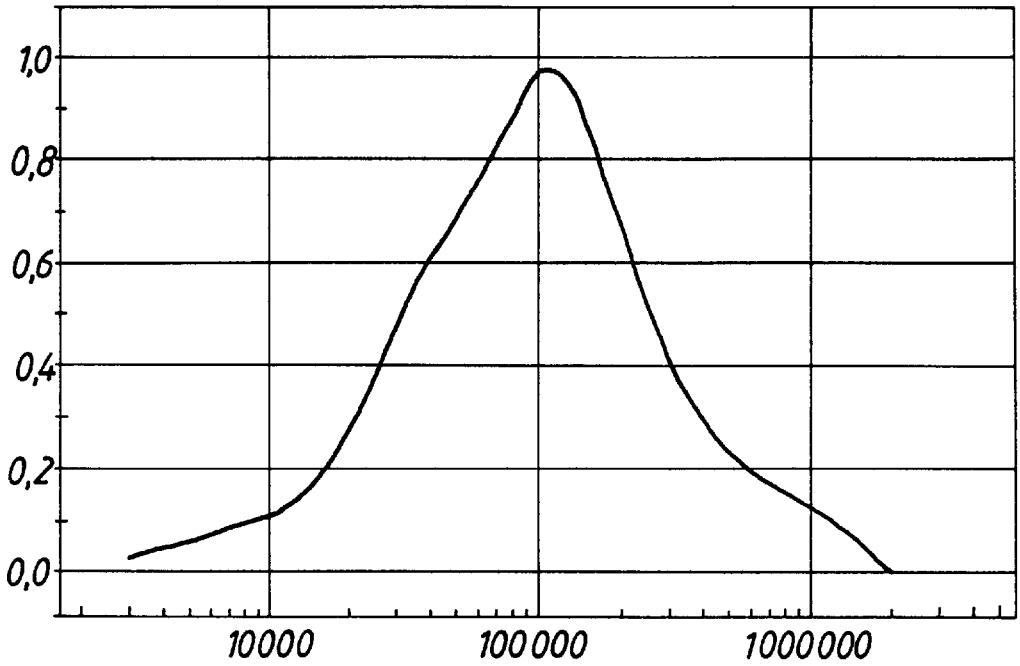

FIG. 1*c* shows the molecular-weight profile of a pulp mixture of 70% Viscokraft LV and 30% Alistaple LD 9.2. With this pulp mixture, the maximum is at about 100,000, and the diagram also shows that this pulp mixture comprises a portion of some 7% of molecules having a molecular weight in excess of 500,000.

Figure 1D:
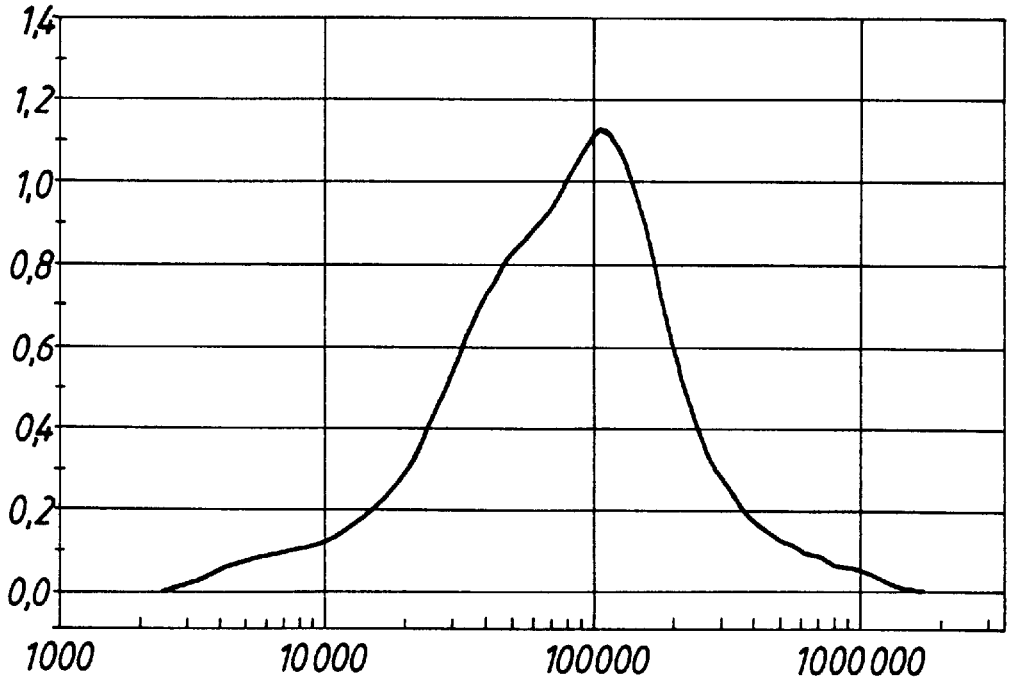

A dope containing 15% of such a mixture—if not allowing for the degradation of the molecules during preparation of the solution—would contain roughly 1% (based on the mass of the solution) of cellulose molecules having a molecular weight in excess of 500,000. Yet, as already mentioned, the cellulose molecules are subject to degradation while dissolving in the aqueous amine oxide, whereby the content of long-chain molecules decreases, and a dope prepared from said mixture has a significantly lower portion of these long-chain molecules. This is shown by FIG. 1*d*, which depicts the molecular-weight profile, drawn up by means of GPC, of the pulp precipitated from the dope immediately before spinning. This dope is the solution of cellulose immediately before spinning, has only 0.4% by mass long-chain molecules left, and hence is a cellulose solution as utilized according to the invention.

A pulp of the type Solucell 400 (manufactured by the firm of Bacell SA, Brazil) likewise exhibits a molecular-weight distribution suitable for the production of a cellulose solution that is in accordance with the invention.

2. Preparation of the dope (spinnable solution of cellulose in an aqueous tertiary amine oxide)

The shredded pulp or a mixture of shredded pulps is suspended in aqueous 50% NMMO, placed in a kneading machine (type: IKA-Laborkneter HKD-T; manufactured by: IKA-Labortechnik) and left to impregnate for an hour. Subsequently, water is evaporated by heating the kneading machine using a heating medium kept at a temperature of 130° C. and by lowering the pressure, until the pulp has completely gone into solution.

3. Spinning of the solution and determination of the maximum drawing rate or the minimum titer (spinnability)

As the spinning apparatus, there is employed a melt-flow index apparatus commonly used in plastics processing, by the firm of Davenport. This appliance consists of a heatable, temperature-controlled steel cylinder into which the dope is poured. By means of a piston which is loaded with a weight the dope is extruded through the spinnerette arranged on the lower face of the steel cylinder, which spinnerette is provided with a hole 100 $\mu$m in diameter.

For the assays, the dope (cellulose content: 15%) that has been placed in the spinning apparatus is extruded through the spinning hole and passed across an air gap having a length of 3 cm into an aqueous precipitation bath, deflected, drawn off over a godet provided following the precipitation bath and thus is stretched. The output of dope through the nozzle is 0.030 g/min. The extrusion temperature is 80° C. to 120° C.

The minimum spinnable titer is used to simulate the spinning behavior. To that end, the maximum drawing rate (m/min) is determined in that the drawing rate is increased until the filament breaks. This velocity is written down and used in calculating the titer by the formula set forth below. The higher this value, the better the spinning behavior or the spinnability.

The titer given at the maximum drawing rate is calculated by the following general formula:

$$titer\,(dtex) = \frac{1.21 \times K \times A \times 100}{G \times L}$$

where K is the concentration of cellulose in % by mass, A is the output of dope in g/minute, G is the drawing rate in m/minute, and L is the number of spinning holes of the spinnerette. In the following examples, the concentration of cellulose is 15%, A=0.030 g/minute, and L=1.

4. Blowing in the air gap Blowing against the filaments in the air gap was effected over their entire length and at right angles to them. The humidity of the air was adjusted by means of a thermostatting device.

5. Spinning behavior of cellulose solutions 5.1. Cellulose solutions having too low a portion (<0.05% by mass) of long-chain molecules In accordance with the working method set forth above, a dope was prepared using the Viscokraft LV pulp (manufactured by: International Paper Corp.) whose molecular-weight profile is depicted in FIG. 1*a* and said dope was spun at different humidities in the air gap and in doing so the maximum drawing rate and the minimum spinnable titer were determined. The results are presented in Table 1.

In Table 1, "temp." means the temperature of the dope in °C., "humidity" means the humidity of the air in the air gap in g water/kg air, and "max. draw. rate" means the maximum drawing rate in m/minute. The titer was calculated by the above formula, and its unit is dtex.

TABLE 1

| Pulp Viscokraft LV | temp. | humidity | max. draw. rate | titer |
|---|---|---|---|---|
| " | 115 | 0 | 176 | 0.31 |
| " | 115 | 20 | 99 | 0.55 |
| " | 115 | 48 | 63 | 0.86 |
| " | 120 | 0 | 170 | 0.32 |
| " | 120 | 22 | 83 | 0.66 |
| " | 120 | 47 | 52 | 1.05 |

The results presented in Table 1 show that as the humidity in the air gap increases, the maximum drawing rate and the minimum titer decrease and increase, respectively. This means that he spinnability of a solution of this pulp, which is practically devoid of long-chain portions, deteriorates as the humidity in the air gap increases.

5.2 Cellulose solutions having too high a portion (>0.70% by mass) of long-chain molecules In accordance with the working method set forth above, a dope was prepared using the Alistaple LD 9.2 pulp (manufactured by: Western Pulp) whose molecular-weight profile is depicted in FIG. 1*b,* and said dope was spun at different humidities in the air gap and, in the process, the maximum drawing rate and the minimum spinnable titer were determined. A reversed result was obtained: Spinnability was slightly better at higher humidities within the air gap than at lower humidities. However, the spinnability of such dopes is in sum markedly poorer, as is obvious from the minimum titer, since the content of high-molecular components is too high already.

5.3 Spinning behavior of cellulose solutions with different portions of long-chain molecules In accordance with the working method set forth above, a dope containing 15% by mass of a mixture of 30% Alistaple LD 9.2 and 70% Viscokraft LV was produced. Immediately before spinning, the pulp mixture exhibited a molecular-weight distribution as shown in FIG. 1*d.* The dope was spun at a temperature of 120° C. at different humidities in the air gap. The result of these assays is given in Table 2 below:

TABLE 2

| Pulp mixture (Alistaple/Viscokraft) | humidity | max. draw. rate | titer |
|---|---|---|---|
| 30/70 | 30 | 116 | 0.47 |
| 30/70 | 50 | 118 | 0.46 |
| 30/70 | 70 | 127 | 0.43 |

It can be clearly seen in the Table that, unlike with a dope having 15% Viscokraft pulp, there is no deterioration of the minimum achievable titer as the humidity prevailing in the air gap increases, but that even a slight improvement can be achieved. Yet, compared with a dope having 15% Alistaple pulp, markedly lower titers can be achieved. It can further be seen that the spinnability of this dope of the invention is relatively independent of the climate prevailing in the air gap.

In numerous spinning trials, for which these or similar pulp mixtures were employed and during which spinning dopes with a composition according to the invention were obtained, the applicant observed that the fibrillation tendency of fibers so prepared was lower compared with the fibrillation tendency of fibers which are not prepared according to the invention. In this respect, during the spinning of dopes which are in accordance with the invention, the fibrillation tendency of the fibers so prepared further decreases with a higher humidity in the air gap.

Figure 2:
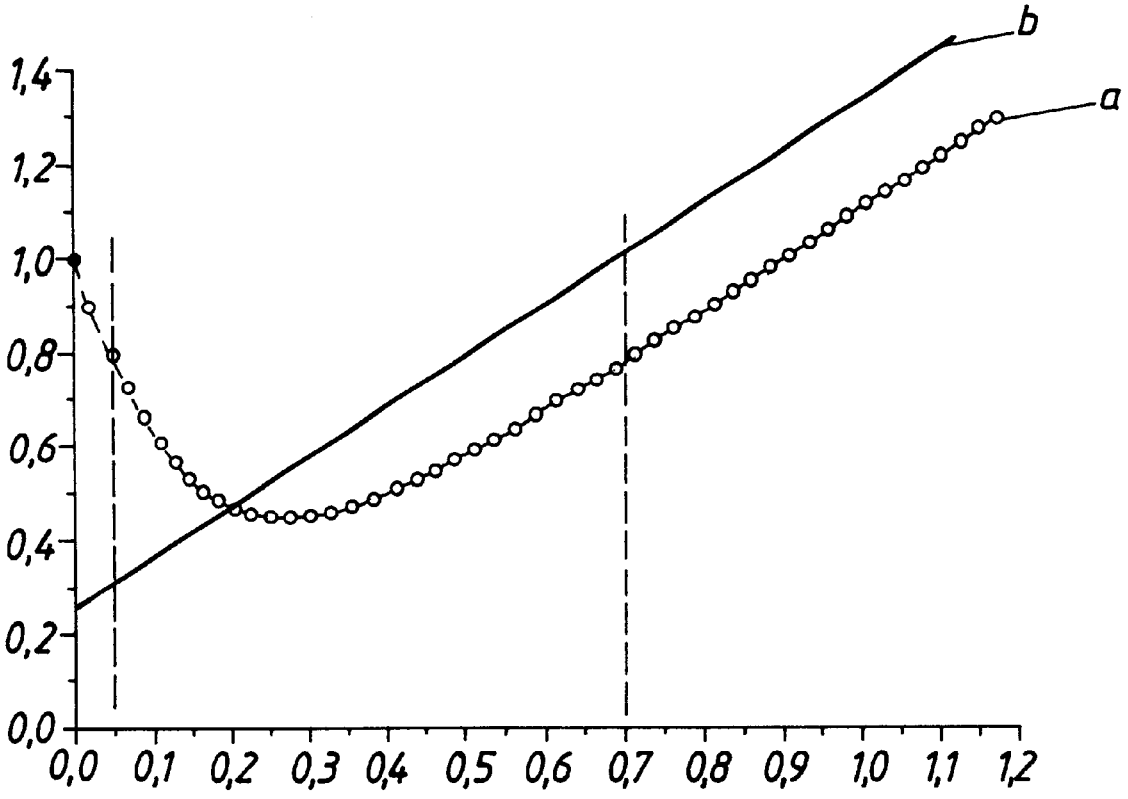
FIG. 2 is a graph of minimum titer (dtex) versus concentration of cellulose molecules having a molecular weight at least 500,000 in a cellulose solution.

FIG. 2 shows the spinning behavior of cellulose solutions with varying portions of long-chain molecules, the minimum titer (dtex) being plotted as the ordinate and, as the abscissa, the concentration of those cellulose molecules of the respective cellulose solution that have a molecular weight of at least 500,000. The concentrations were determined immediately before spinning.

The portion of long-chain molecules was adjusted by admixing appropriate amounts of Alistaple LD 9.2 to Viscokraft LV. The concentration of cellulose in the solution was 15% by mass in all cases.

For each solution of cellulose, the spinning behavior was determined both at a humidity in the air gap of 30 g $H_2O$ (curve "a") and at 0 g $H_2O$ (dry) (straight line "b").

From FIG. 2 it can be seen that:

there is a connection between the spinnability and the concentration of long-chain molecules;

if dry air prevails in the air gap (straight line "b"), spinnability will improve in an approximately linear manner as the concentration of long-chain molecules decreases;

if humid air prevails in the air gap (curve "a"), spinnability initially will become better and better as the concentration of long-chain molecules decreases, but from a concentration of about 0.25% by mass downwards will deteriorate again, with the deterioration being particularly pronounced from 0.05% by mass downwards.

In FIG. 2, the range of the invention (0.05 to 0.70% by mass) is marked in the drawing. In that range, the minimum titer only varies within the range between about 0.4 dtex and 0.75 dtex, namely irrespective of the humidity within the air gap. This means that within that range the spinnability is practically independent of the moisture in the air gap and that dopes with long-chain molecules in the concentration range indicated in the invention can be spun into dense filament curtains in which the air humidity has practically no negative effect on spinnability, thus eliminating the need for expensive climatization and conditioning of the blowing air.

Through extensive experimentation, applicant has discovered that in this manner filament curtains of high linear density, namely a linear density of at least 20, which are blown against with normal air, can be spun.

6. Fibrillation properties of fibers made from dopes according resp. not according to the invention According to the method described in para. 2., cellulose dopes with a total cellulose concentration of 15 weight percent were prepared.

As the cellulosic material, the following pulps and pulp mixtures were employed:

1) Viscokraft LV (100%)

2) Viscokraft LV (85%), Alistaple LD 9.2 (15%)

The cellulose dope containing 100% Viscokraft LV as the cellulosic material did immediately before spinning not correspond to a dope utilized in accordance with the invention.

The cellulose dope containing 85% Viscokraft LV and 15% Alistaple LD 9.2 as the cellulosic material did immediately before spinning correspond to a dope utilized in accordance with the invention.

From these cellulose dopes, fibers were prepared according to the method described in para. 3. In the separate trials, air with different humidities was employed for the blowing against the filaments in the air gap (cf. 4.), whilst all other parameters remained constant. From the fibers so prepared, the fibrillation tendency was measured according to the following test method:

The abrasion of the fibers among each other during the washing process respectively during finishing processes in the wet condition was simulated by the following test: 8 fibers with a length of 20 mm were introduced to a 20 ml sample bottle with 4 ml of water and shaken over a nine hour period in a laboratory mechanical shaker of the type RO-10 from the company of Gerhardt, Bonn (FRG), at level 12. Following this, the fibrillation behavior of the fibers was evaluated under the microscope by counting the number of fibrils for each 0.276 mm of fiber length.

RESULTS:

The fibrillation property determined according to the above test method is listed in the following table:

| Pulp employed | titer (dtex) | humidity of blowing air (g $H_2O$/kg air) | number of fibrils |
|---|---|---|---|
| 100% Viscokraft LV | 1.7 | 10 | >50 |
| 15% Alistaple LD 9.2<br>85% Viscokraft LV | 1.7 | 10 | 24 |
| 15% Alistaple LD 9.2<br>85% Viscokraft LV | 1.7 | 20 | 12 |

From the table it can be easily seen that the tendency to fibrillation of fibers made from cellulose dopes with a composition according to the invention is lower compared with fibers made from cellulose dopes with a composition which is not in accordance with the invention. Furthermore, it can be seen from the table that the tendency to fibrillation of fibers made from cellulose dopes with a composition according to the invention even further decreases if air with a higher humidity is employed for the blowing against the filaments.

What is claimed is:

1. Method of producing lyocell-type cellulose fibers by processing a spinnable solution of cellulose in an aqueous tertiary amine oxide according to the dry/wet-spinning process comprising:

providing a solution having a content of between 0.05% by mass and 0.70% by mass, based on the mass of the solution, of cellulose having a molecular weight of at least $5\times10^5$ and, spinning and processing the solution into fibers.

2. Method according to claim 1 comprising providing a solution having a content of between 0.10 and 0.55% by mass, based on the mass of the solution, of cellulose with a molecular weight of at least $5\times10^5$.

3. Method according to claim 2 comprising providing a solution having a content of between 0.15 and 0.45% by mass, based on the mass of the solution, of cellulose with a molecular weight of at least $5\times10^5$.

4. Method according to any one of claims 1 to 3, wherein the tertiary amine oxide is N-methyl-morpholine-N-oxide.

5. Method of producing cellulose fibers of the lyocell type by processing a spinnable solution of cellulose in an aqueous tertiary amine oxide by the dry/wet-spinning process comprising:

(1) providing a solution having a content of between 0.0–5 and 0.70% by mass, based on the mass of the solution, of cellulose with a molecular weight of at least $5\times10^5$ and (2) spinning the solution with a spinnerette having more than 10,000 spinning holes which holes are arranged in such a manner that neighboring spinning holes are spaced maximally 3 mm apart and that the linear density of the spinning holes is at least 20.

* * * * *

UNITED STATES PATENT AND TRADEMARK OFFICE

CERTIFICATE OF CORRECTION

PATENT NO. : 6,241,927 B1
DATED : June 5, 2001
INVENTOR(S) : Mülleder et al.

It is certified that error appears in the above-identified patent and that said Letters Patent is hereby corrected as shown below:

Title page,
Item [57], ABSTRACT,
Line 13, "it" should read -- is --.

Column 1,
Lines 35 and 54, "f.i." should read -- e.g. --.

Column 4,
Line 51, "it" should read -- is --.

Column 5,
Line 19, ""I"" should read -- "I" --.

Column 7,
Line 16, "L=1." should read -- L=1. --.

Column 9,
Line 17, "2.," should read -- 2., --.

Column 10,
Line 32, "$5x10^5$ and," should read -- $5x10^5$, and" --.
Line 49, "0.0-5" should read -- 0.05 --.
Line 51, "$5x10^5$ and" should read -- $5x10^5$, and" --.

Signed and Sealed this

Fourth Day of January, 2005

JON W. DUDAS
*Director of the United States Patent and Trademark Office*